US006168828B1

(12) United States Patent
Chernyshov et al.

(10) Patent No.: US 6,168,828 B1
(45) Date of Patent: Jan. 2, 2001

(54) LABYRINTH GAS FEED APPARATUS AND METHOD FOR A DETONATION GUN

(75) Inventors: Alexandr Vladimirovich Chernyshov; Georgy Yur'evich Barykin, both of Kiev (UA)

(73) Assignee: Aerostar Coating, S.L., Irun (ES)

( * ) Notice: Under 35 U.S.C. 154(b), the term of this patent shall be extended for 0 days.

(21) Appl. No.: 09/091,879

(22) PCT Filed: Dec. 23, 1996

(86) PCT No.: PCT/US96/20160

§ 371 Date: Dec. 21, 1998

§ 102(e) Date: Dec. 21, 1998

(87) PCT Pub. No.: WO97/23303

PCT Pub. Date: Jul. 3, 1997

(30) Foreign Application Priority Data

Dec. 26, 1995 (UA) ..... 95125490

(51) Int. Cl.[7] ..... B05D 1/12; B05B 1/34

(52) U.S. Cl. ..... 427/180; 427/190; 427/191; 427/421; 118/308; 118/309; 239/79; 239/80

(58) Field of Search ..... 427/180, 190, 427/191, 421; 118/308, 312, 309; 239/79, 80, 81, 85

(56) References Cited

U.S. PATENT DOCUMENTS 4,258,091 3/1981 Dudko et al. .
4,669,658 * 6/1987 Nevgod et al. .
5,052,619 * 10/1991 Ulyanitsky et al. .
5,542,606 8/1996 Kadyrov et al. .

FOREIGN PATENT DOCUMENTS 36 14 098 10/1987 (DE) .
2 274 365 1/1976 (FR) .
2 099 332 * 12/1982 (GB) .
1 827 872 3/1996 (SU) .

OTHER PUBLICATIONS

Database WPI, Section Ch, Week 9648, Derwent Publications Ltd., London, GB; Class M13, AN 96–484294, XP002028470.

* cited by examiner

*Primary Examiner*—Fred J. Parker
(74) *Attorney, Agent, or Firm*—McDermott, Will & Emery

(57) ABSTRACT

A gas feed system for detonation gun apparatus having a labyrinth shaped gas path. The labyrinth is positioned between the fuel and oxygen supply and the combustion chamber of a detonation gun. The labyrinth allows the fuel and oxygen supply to flow into the combustion and precludes and migration of the detonation wave front into the fuel supply by destroying that portion of the detonation wave front that enters the labyrinth. The labyrinth gas feed system increases safety, reliability and productivity of the detonation coating process.

8 Claims, 6 Drawing Sheets

FIG. 2
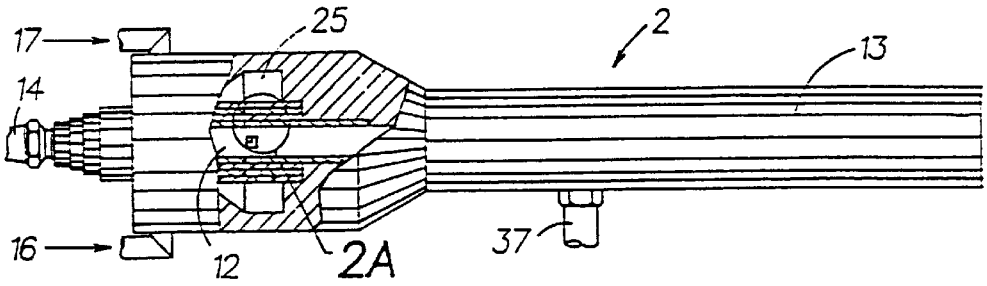
FIG. 2A
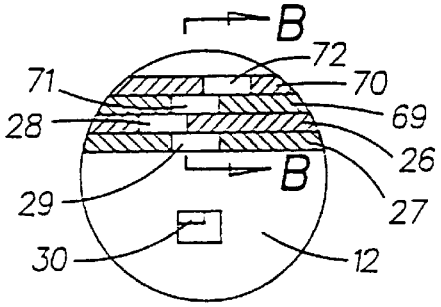
FIG. 2B
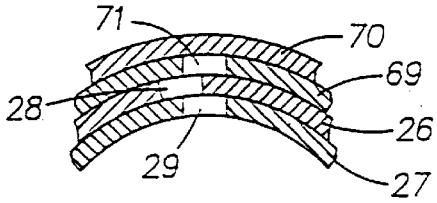
FIG. 3
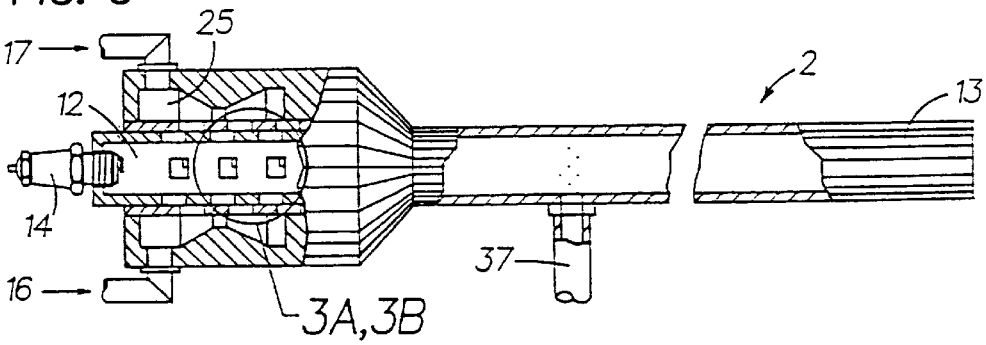
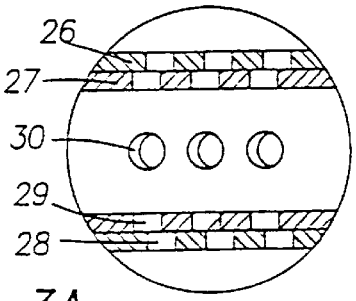
FIG. 3A
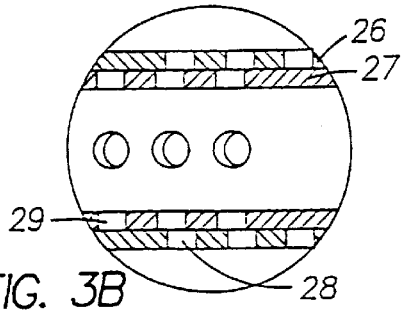
FIG. 3B

LABYRINTH GAS FEED APPARATUS AND METHOD FOR A DETONATION GUN

TECHNICAL FIELD

This invention relates to the field of gas detonation coating apparatus for industrial use for applying protective coatings to workpieces.

BACKGROUND ART

Many industrial applications exist where materials are exposed to severe environmental conditions of heat, wear and corrosion. Spray coating processes utilizing powder coating materials offer high quality protection in some of these applications. A common method of spray coating is the detonation gun process. This process uses kinetic energy from the detonation of combustible mixtures of gases to deposit powdered coating materials on workpieces.

Typical coating materials used in conjunction with detonation guns in the spray coating process include powder forms of metals, metal-ceramic, ceramic, erosion resistant, thermal protection, electrically insulating, electrically conductive, and other coating materials. In addition powder forms of other materials can be utilized in conjunction with the detonation gun process for parts cleaning, hole drilling, making powders, and other conceivable applications.

A typical detonation gun functions in the following manner. A certain amount of a combustible gas mixture, oxygen and acetylene for example, is fed into a tubular combustion chamber have a closed end and an open end where it is subsequently ignited by a spark plug. The ignition of the gas brings about detonation and the formation of a shock wave. The shock wave travels down the combustions chamber to the open end which is attached to a tubular barrel. A suitable coating powder is typically injected into the barrel in front of the propagating shock wave and is subsequently carried out the open end of the barrel and deposited onto a substrate positioned in front of the barrel. The impact of the powder onto the substrate produces a high density coating with good adhesive characteristics. The process is repeated in a rapid fashion until the workpiece is coated to satisfaction. Between successive ignitions an inert gas, such as nitrogen, may be fed into the combustion chamber after the ignition to halt combustion and prevent backfire into the fuel and oxygen supply and to purge the barrel of combustion products.

The mechanics of detonation are key to the operation of the detonation gun. Detonation produces shock waves that travel at supersonic velocities, as high as 4000 m/s, and elevated temperatures, as high as 3137° C. Detonation in the detonation gun is controlled by the type of fuel used, such as propane, acetylene, butane, etc., the fuel and oxygen mixture ratio, the initial pressure of the gases in the combustion chamber, and the geometry of the combustion chamber. After ignition of the fuel and oxygen mixture deflagration produces an initial detonation wave front that increases the temperature and pressure within the combustion chamber which in turn propagates ignition of the combustible mixture throughout the combustion chamber. Given the correct combination of parameters, the detonation continues to propagate until all available fuel and oxygen is consumed. The detonation front moves toward the open end of the combustion chamber and into the barrel. It is of particular importance that the combustion chamber be of sufficient length, for the specific detonable mixture in use, to complete the transition from deflagration to detonation before entering the barrel or the detonation wave front may not be sustained within the barrel. It is also important in the operation of a detonation gun to produce as strong a shock wave as possible and direct it to the barrel as efficiently as possible so that a large amount of the kinetic energy of the detonation wave goes directly to carrying the powder out of the barrel and onto the substrate.

At a fixed moment in time the detonation wave front is made up of a system of individual stationary detonation cells. The behavior of detonation at the cell level is an important attribute in the control and operation of a typical detonation gun. The detonation cell is a multidimensional structure which includes both the detonation wave front and transverse detonation waves moving perpendicular to the detonation front. The frontal surface of a detonation cell consists of convex shaped mach wave. Behind the mach wave is a reaction zone where the chemical reactions take place that lead to detonation. At the edge of the cell transverse shock waves form a substantially right angles to the frontal surface of the detonation cell. The transverse waves have acoustic tails that extend from the aft edges oft he transverse waves and define the aft edge of the detonation cell. The transverse waves move from cell to cell and reflect off of each other and off of any limiting structure such as the combustion chamber wall. Once detonation has been initiated the reaction continues in a fairly stable fashion. However, the detonation wave front structure can be negatively by collisions with reflecting transverse waves and reflecting refracted waves from the detonation front while moving through the combustion chamber. These collisions diminish the intensity of the detonation cells and therefor lessen the amount of kinetic energy available to be transferred to the coating powder. This reduction in energy transferred to the coating powders translates into a reduction of the coatings produced in terms of density and adherence with the substrate. The residuum of detonation wave front moves from the combustion chamber into the barrel and out onto the workpiece.

The size of the detonation cell is another important attribute in the control and operation of a detonation gun. Cell size is a function of the molecular nature of the fuel, the initial pressure within the combustion chamber, and the fuel/oxygen ratio. The particular cell size for certain conditions can be determined experimentally. The width of a cell, Sc, is measured along the wave front between successive transverse waves. The length of a cell, Lc, is the perpendicular distance from a line tangent to the wave front measured to the intersection point of the acoustic tails from adjacent transverse waves. The typical ratio of cell width to cell length is Sc=0.6 Lc for the detonable gases under consideration. The physical parameters of a particular typical detonation gun, such as the geometry and operating pressures, are determined by the cell size of a particular fuel and oxygen mixture.

The operating pressure within the combustion chamber is influenced by the behavior of the detonation cells. Prior to ignition the pressure within the combustion chamber is controlled by the fuel and oxygen supply pressures and the geometry of the combustion chamber. After ignition of the mixture the pressure within the combustion chamber increases and reaches a maximum when detonation occurs. As the detonation wave travels down the barrel and reaches the open end of the barrel a peak rarefaction pressure is measured within the combustion chamber. A positive pressure peak is then subsequently measured within the combustion chamber due to the presence of reflected waves from the detonation wave front.

In a typical detonation gun the coating powder, such as Amperit, is fed either directly into the barrel directly or into the combustion chamber and then carried into the barrel by inert gases ahead of the detonation wave. For example, a certain powder feeder utilizes a continuous supply of air or inert gas to carry the powder fed from a continuous source through a valve arrangement and finally into the gun. The operation of the valve is coordinated with the firing of the spark plug so that the powder and carrying gases are in position along the barrel to be properly effected by the detonation wave. Typically the valves are opened by mechanical means such as a cam and tappets or a solenoid. The disadvantage of these mechanisms is that they often limit the frequency at which the gun can fire because the valve must be opened far enough and long enough to permit the passage of the proper amount of powder through the valve. These mechanisms also pose reliability problems in that they have rapidly moving pieces and transport powders that tend to be abrasive in nature leading to gun life cycle and maintenance concerns. In addition, valves pose safety concerns in that a valve that leaks, sticks open or breaks gives an alternate and potentially harmful path for the detonation wave front to escape.

The rate at which a detonation gun deposits the coating powder on the workpiece is an important economic parameter in industrial applications. The deposition rate is controlled, and at times limited, by a variety of factors such as the type of fuel, the fuel supply system, the geometries of the combustion chamber and barrel, the powder feeder system, and the purging of the system between successive ignitions. Deposition rate is expressed as the ratio between the spray rate and spray spot square. The spray rate is stated in terms of the mass of coating powder utilized per unit time, typically Kg/hr, and typically ranges from 1 to 6 Kg/hr. Spray rate is obviously influenced to great extent by the rate at which the spark plug is ignited. In a typical detonation gun the spark plug is ignited at the maximum rate of 6 to 10 times per second. The spray spot square is the area coated by a single ignition of the gun and is roughly equal to the area of the barrel and is typically expressed as $mm^2$. A typical industrial detonation gun has a deposition rate of about 0.001 to 0.02 $Kg/mm^2$-hr.

In the typical detonation gun the combustible fuels and oxygen are supplied in gas form either into a mixing chamber or directly into the combustion chamber itself through a series of valves. The combustible gases are supplied under pressure of about 1 to 3 Mpa from a continuous source to the valve system before being issued into the gun. The opening of the valve system is synchronized to properly proportion the gases and to prevent backfire. As discussed previously a valve system as employed in a typical detonation gun raises serious concerns about rate, reliability and safety.

An important characteristic affecting the quality of the coatings produced by the detonation gun is the supersonic velocities at which the shock waves travel. The shock waves carry the coating powders at such velocities and, therefore, the coatings that are produced achieve higher densities and better adhesive qualities than other spray coating methods. The velocity of the coating powder as it exits the barrel is influenced by, among other things, the type of fuel used, and the geometries of the combustion chamber and barrel. Typical detonation wave velocities for detonable gas mixtures lie between 1200 m/sec and 4000 m/sec with $H_2$—$O_2$ at 2830 m/sec and $CH_4$—$O_2$ at 2500 m/sec. The maximum achievable velocity in present detonation gun configurations is approximately 3000 m/sec.

The temperatures surrounding the operation of a detonation gun is yet another important characteristic affecting the quality of the coatings produced and concerning its use as an industrial coating apparatus. Typical adiabatic flame temperatures for detonable gas mixtures of concern range from 1947° C. to 3137° C. with $H_2$—$O_2$ at 2807° C. and $CH_4$—$O_2$ at 2757° C. It is often desirable to melt the coating powders before depositing them on the substrate and given the correct parameters these temperatures are high enough to melt certain powder coating materials. The temperature imparted to the powders is in part controlled by barrel geometry and in part controlled by active cooling of the barrel. These temperatures are high enough to melt most substrate materials, however, the discontinuous nature of the combustion within a detonation gun prevents the substrate from being adversely affected.

The use of non-combustible gases in the operation of a detonation gun also affects the quality of the coatings produced. There are three common uses of non-combustible gases in detonation gun operations: 1. As purging gases; 2. As powder carrier gases; and 3. As a control on the detonation process. Purging gases typically are inert gases and are used primarily to purge the combustion chamber between successive firings of the spark plug to arrest the combustion process. This is important in the typical detonation gun because the combustion chamber must be filled between successive firings of the spark plug with new amounts of combustible fuel and oxygen mixture through a series of valves. If combustion continued in the combustion chamber while the valves are opened it is possible that the combustion would continue into the fuel and oxygen supply and cause an explosion. One of the problems with using purging gases is that they mix with the combustible gases and lower the overall kinetic energy of the detonation because the inert gases are by their very nature non-combustible. Therefore the kinetic energy available for transferring to the coating powders is lessened and coating density and adhesion will be adversely affected. In addition, the purging gases mix with the coating powder and slightly alter the final composition of the coatings produced. Powdered carrier gases, frequently compressed air, are typically used to transfer the coating powders from a reservoir to the barrel of the detonation gun in front of the detonation wave front. These gases also lessen the kinetic energy available for transfer to the coating powders because they lower the temperature and velocity of the detonation wave front. The effect on coating quality is evidenced by a lower density coating and poorer adhesion with the substrate. As a control on the detonation process, inert gases are also mixed with the detonable gases. These are typically used in small amounts to control the temperature, velocity and chemical environment of the combustible products.

DISCLOSURE OF INVENTION

In general, the present invention is a labyrinth shaped gas feed system for a detonation coating apparatus which substantially increases safety, reliability and productivity. The labyrinth functions to supply a fuel and oxygen mixture to a combustion chamber wherein detonation takes place. The labyrinth works to preclude the detonation from subsequently migrating into the fuel and oxygen supply thus preventing backfire. In addition, the labyrinth functions as a valve to instantaneously interrupt the flow of fuel and oxygen into the combustion chamber.

The labyrinth of the present invention is associated with the combustion chamber and positioned between the combustion chamber and the fuel and oxygen supply of a detonation gun. The fuel and oxygen mixture flows through the labyrinth into the combustion chamber. The fuel and oxygen mixture is then ignited to produce a detonation wave front. As the detonation wave front travels past an opening to the labyrinth a portion thereof diffracts off of the detonation wave front and moves into the opening of the labyrinth. The labyrinth has a tortuous path that interferes with and destroys the detonation cells of the diffracted portion of the detonation wave front thereby precluding detonation from traveling into the fuel and oxygen supply and causing backfire. Once destroyed, the residuum of the pressure from the diffracted portion of the detonation wave front overcomes the opposing pressure of the fuel and oxygen supply and acts to instantaneously interrupt the flow of the fuel and oxygen mixture into the combustion chamber. The combined effect of the present invention is to both preclude backfire into the fuel and oxygen supply and to act as a valve to interrupt the flow of the fuel and oxygen supply into the combustion chamber.

BRIEF DESCRIPTION OF DRAWINGS

FIG. 2 is an illustration, partially in section, of the labyrinth of the present invention.

FIG. 2A is an enlarged view of area 1 in FIG. 2 illustrating the labyrinth in the circumferential direction.

FIG. 2B is an enlarged view taken substantially along line B—B in FIG. 2A illustrating the detail of the labyrinth in the axial direction.

FIG. 3 is a plan view, partially in section, of an alternative embodiment of the labyrinth.

FIG. 3A is an enlarged view of area 1 in FIG. 3 in accordance with a preferred embodiment of the present invention presented in a first position with three sets of open apertures.

FIG. 3B is an enlarged view of area 1 in FIG. 3 in accordance with a preferred embodiment of the present invention presented in a second position with two sets of open apertures.

BEST MODE FOR CARRYING OUT THE INVENTION

Figure 1:
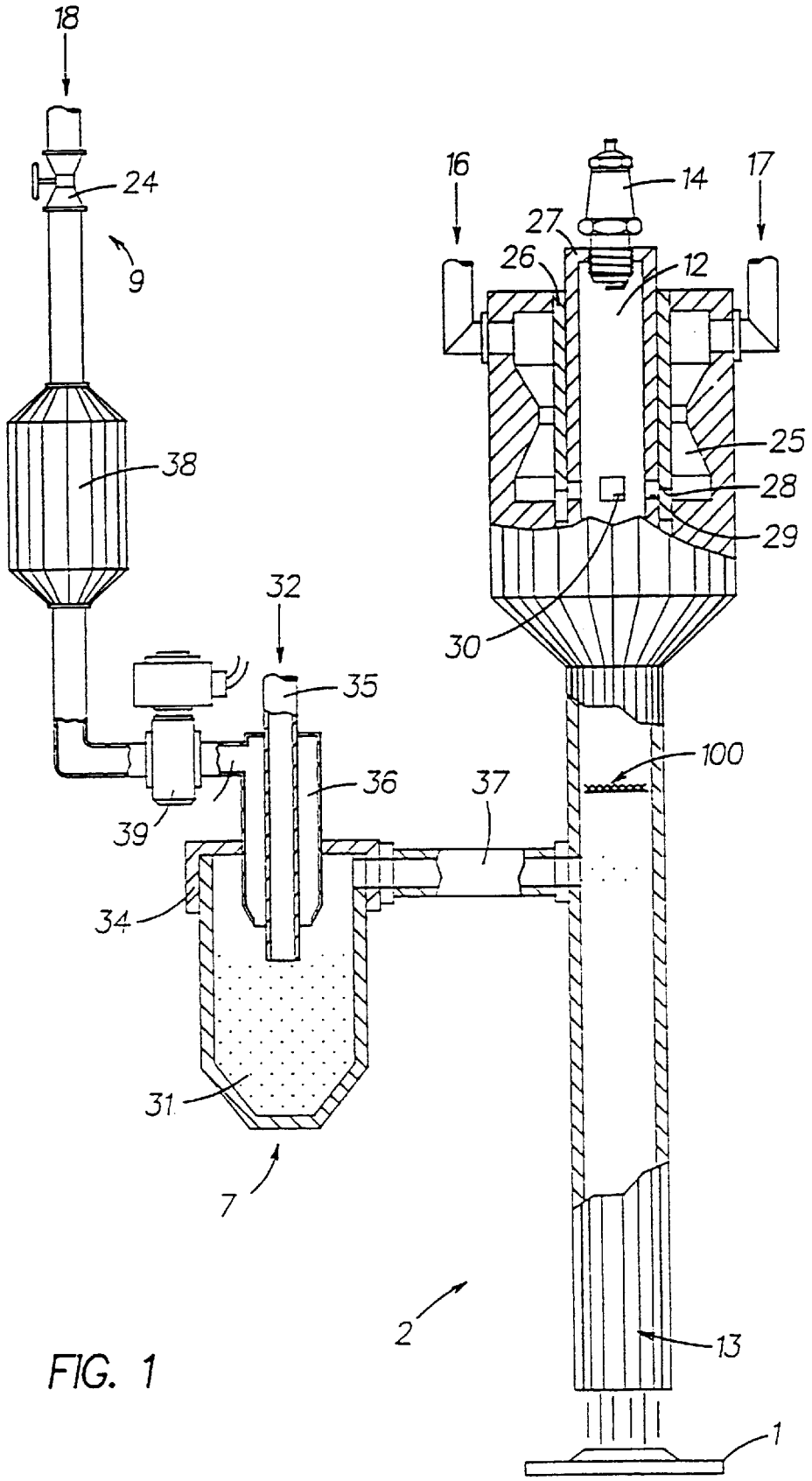
FIG. 1 is a plan view, partially in section, of a detonation gun and pulsed powder feeder system of the present invention.

An apparatus is shown in FIG. 1 for applying coatings to a substrate 1 which comprises a detonation gun 2, and a powder feeder system 7. The detonation gun comprises a combustion chamber 12, a barrel 13, and a spark plug 14. The powder feeder system comprises a high pressure chamber 38, a stop valve 39, a branch pipe 40, a powder inlet pipe 35, a nozzle 36, a hopper 31, and a powder outlet tube 37. Supply gases enter a mixing chamber 25 through supply pipes 16, 17 where they form a combustible mixture before passing into the combustion chamber 12. The combustible mixture is ignited by the spark plug and produces a detonation wave front 100 that travels out of the combustion chamber and into the barrel 13. A carrier gas 18 is supplied to the high pressure chamber 38 of the powder feeder system. A spraying powder 32 is fed into the hopper 31 from a powder source (not shown). The stop valve 39 introduces the carrier gas into the powder hopper wherein it transports a portion of the spraying powder out of the hopper through the powder outlet removal tube 37 and into the barrel 13. The opening of the stop valve 39 is timed such that the powder is introduced into the barrel just ahead of the detonation wave front 100. The force of the detonation wave front carries the spraying powder down the barrel and onto the substrate 1.

Referring to FIG. 2 and FIG. 2A the combustion chamber 12 is coaxially positioned between an arrangement of concentric bushings 70, 69, 26, and the mixing chamber 25. Located in the sidewall 27 of the combustion chamber and bushings are apertures 72, 71, 28 and 29. The bushings are adjustable with respect to the combustion chamber in the axial and circumferential directions and are registered with the combustion chamber and each other such that the apertures therein form a labyrinth 30 between the combustion chamber and the mixing chamber. The labyrinth for a given combustible mixture is defined by the registration of the apertures in such a manner that the opening between adjacent apertures is no greater than the detonation cell length in the axial direction FIG. 2A and no greater than the detonation cell width in the circumferential direction FIG. 2B. In the preferred embodiment the alignment of non-adjacent apertures are staggered such that there is no through hole created from the combustion chamber to the mixing chamber. The purpose of the labyrinth is to destroy detonation cells which would otherwise propagate into the mixing chamber and cause backfiring into the supply pipes 16, 17 and to act as a gas-dynamic valve to interrupt the flow of the combustible mixture to the combustion chamber.

The combustible mixture flows through the labyrinth 30 into the combustion chamber. The spark plub 14 ignites the mixture and a detonation wave front forms, propagates in all directions and moves down the combustion chamber toward the barrel 13 of the detonation gun 2. The detonation propagates until it encounters a limiting structure or depletes the supplied fuel and oxygen. Detonation cells diffract from the propagating detonation wave front and enter into the first aperture 29 of the labyrinth. The labyrinth destroys the detonation cells by restricting the size of the opening such that a full cell cannot progress through the labyrinth without colliding with at least one bushing wall. In addition, the labyrinth destroys the detonation cells by reflecting detonation cells that come into contact with the bushing walls backwards into subsequently diffracted oncoming detonation cells. The restrictions within the labyrinth and collisions of the detonation cells produce a pressure drop in the diffracted detonation cells sufficient to arrest the otherwise self supporting nature of detonation and rendering it impossible for detonation to proceed into the mixing chamber. The ability of the labyrinth to destroy detonation cells averts the need for complex backfire prevention apparatus. The residuum of pressure associated with the destroyed, diffracted detonation cells overcomes the pressure of the fuel and oxygen supply in the labyrinth and functions as a gas-dynamic valve. The fuel and oxygen supply is instantaneously interrupted by the gas-dynamic valve allowing the combustion chamber to be depleted of all combustible gases as is explained more fully herein below.

Another embodiment of the present invention of the labyrinth is shown in FIG. 3. The combustion chamber 12 in FIG. 3A is adjusted such that apertures 28 and 29 form labyrinth 30 as described herein above. In FIG. 3B the combustion chamber has been adjusted axially to misregister apertures 28 and 29 such that aperture 28 is registered with aperture 91 to thereby form a labyrinth and aperture 29 is closed off from the mixing chamber 25. In this configuration the amount of fuel and oxygen is limited to the two rows of remaining labyrinth in FIG. 3B. This limiting feature is valuable in the ability to utilize the detonation gun of the present invention with different fuel and oxygen mixtures and different applications where varying amounts of fuel and oxygen are required.

The mixing chamber 25 in FIG. 1 has an optional converging portion located between the fuel and oxygen supply and the labyrinth. The converging portion of the mixing chamber acts with combusted gases to create a gas-dynamic valve similar to that described above. The gas-dynamic valve instantaneously disrupts the flow of combustible gas into the combustion chamber. The labyrinth destroys the diffracted detonation cells as the combusted gases travel through it from the combustion chamber to the mixing chamber, however, the combusted gases remain at sufficient pressure to overcome the supply pressure of the fuel and oxygen. The gas-dynamic valve within the mixing chamber stops the flow of the combusted gases and prevents the combusted gases from flowing into the fuel and oxygen supply and at the same time instantaneously interrupts the flow of fuel and oxygen into the combustion chamber. With the flow of fuel and oxygen interrupted within the mixing chamber the detonation within the combustion chamber depletes all available fuel and oxygen within the combustion chamber itself. This use of the labyrinth as a gas-dynamic valve provides for a discontinuous flow of combustible gases to the combustion chamber from a continuous source without the need for complicated valves and eliminates the need for purging gases. The elimination of mechanical valves to interrupt the flow of fuel and oxygen increases the reliability and safety of the detonation gun. The abolishment of purging gases produces a much better quality coating for several reasons. First, the detonation itself is more stable because the combustion chamber is filled only with combustible gases and therefore the detonations are stronger and more consistent resulting in coating layers that are more dense and have better adhesion both with the substrate and between layers. Second, the coatings that are produced are more homogeneous because there are no byproducts of the purging gases to mix with the coating powder. Third, due to the controllable conditions and composition of each coating layer, the stresses through the coating thickness layers are reduced and therefore, the coatings can be applied much thicker than in prior art detonation guns. And lastly, the abolishment of the purging gases leads to higher deposition efficiency because the coating powders do not interact with the relatively cold purging gas.

Figure 4:
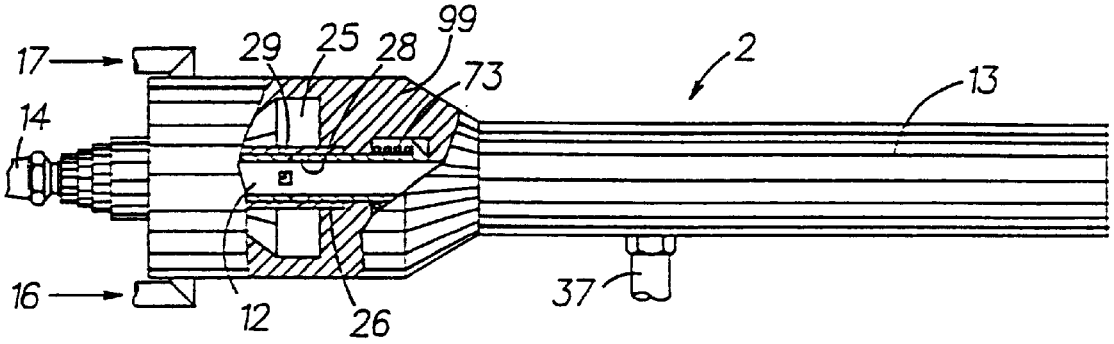
FIG. 4 is a plan view, partially in section, of the recoil system of an embodiment of the present invention.

Alternative embodiment to the labyrinth is shown in FIG. 4. In this embodiment the combustion chamber reciprocates to close off the fuel and oxygen supply from the combustion chamber. The combustion chamber 12 is located in a similar fashion to the previously described embodiment with the exception that it is slidably mounted in the axial direction within the body 99 of the detonation gun 2. Located in the wall of the combustion chamber is aperture 29 and bushing 26 with at least one aperture 28. The upstream end of the combustion chamber is closed and houses the spark plug 14. The downstream end of the combustion chamber is open and in communication with the barrel 13. A spring 73 is concentrically located on the outer surface of the combustion chamber and captured between the body and the combustion chamber. The spring biases the combustion chamber in the downstream direction. With the combustion chamber in the biased position the aperture 29 is aligned with the aperture 28 to allow for the flow of combustible gases into the combustion chamber. During combustion the peak pressure force acts on the upstream end of the combustion chamber, overcomes the spring force, and the combustion chamber moves upstream relative to the detonation gun body. The aperture 29 advances past the aperture 28 to isolate the mixing chamber from the combustion chamber, prevents backfiring into the fuel and oxygen supply and instantaneously interrupts the flow of fuel and oxygen into the combustion chamber.

Figure 5:
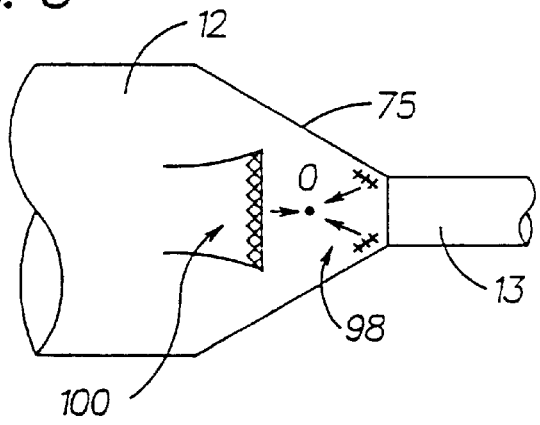
FIG. 5 is an illustration of a combustion chamber of the prior art with a representation of detonation waves and depicting the detrimental effects of reflected energy within a combustion chamber.
Figure 6A:
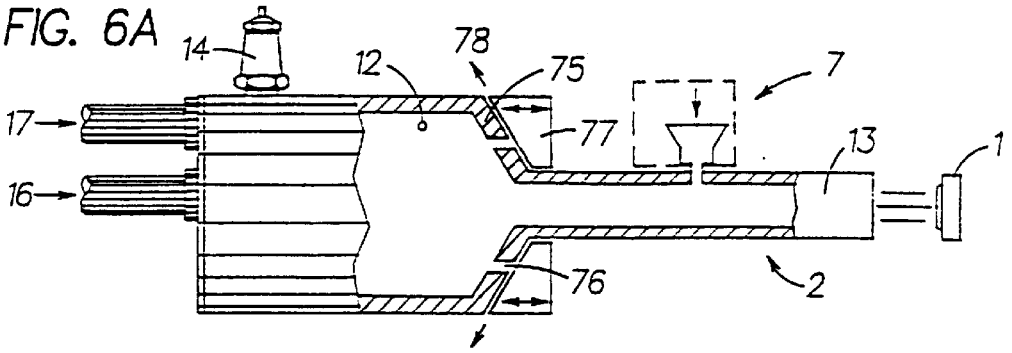
FIG. 6A is a plan view, partially in section, of a detonation gun illustrating an exemplary energy bleed system of the present invention.
Figure 6B:
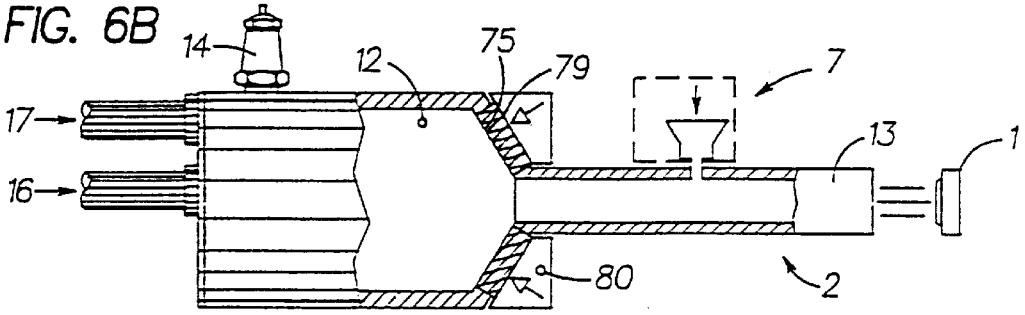
FIG. 6B is a plan view, partially in section, of a detonation gun illustrating an alternative embodiment of an energy bleed system of the present invention.

Detonation propagates cell by cell in the combustion chamber until it depletes the fuel and oxygen supply or meets with an obstruction such as the wall of the combustion chamber. When detonation cells meet obstructions some of the energy is absorbed and the remainder is reflected back off of the obstruction. As described earlier herein these reflected waves have a negative effect on the performance of the detonation gun as they collide with and diminish the intensity of the detonation wave front. These collisions are most determinental as the detonation wave front moves down the combustion chamber and as it moves down the barrel. FIG. 5 illustrates how this occurs. The detonation wave front 100 is initiated in the combustion chamber 12 and is forwarded to the barrel 13. The detonation wave front interacts with converging surface 75 and the resulting reflected waves 98 collide with the detonation wave front and diminish the intensity or destroy the detonation wave front before passing into the barrel. In the arrangement of the present invention an energy bleed system as illustrated in FIG. 6A is provided to extract the reflected waves that would otherwise interfere with the detonation wave front. The system utilizes a bleed aperture 76 located in the converging wall 75 to remove the portion of the detonation wave front that would otherwise be reflected off of the converging wall. The bleed aperture can take on a number of configurations such as holes, slots, porous material 79 in FIG. 6B, or any other configuration capable of eliminating the detrimental reflected waves. An additional feature of the present invention is a means to adjust the cross sectional area of the bleed aperture via a regulator 77 as in FIG. 6A or the absorbabtivity of the porous medium via a damper 80 as in FIG. 6B. The use of an energy bleed system eliminates the reflected waves that would otherwise diminish the intensity of the detonation wave front and allow the detonation wave front to progress into the barrel with the highest available kinetic energy. The coating quality is thereby increased because more energy can be transferred to the powder.

Another embodiment of the present invention is the mini detonation gun which deals with the effect of reflected waves within the barrel itself. In a detonation gun of the prior art, portions of the detonation wave front are reflected off the walls of the barrel as the detonation wave front progresses down the barrel, collide with the detonation wave front and diminish the intensity of the detonation wave front before exiting the barrel. FIG. 6A is an illustration of a mini detonation gun wherein a single detonation cell is forwarded to the barrel 13 from the combustion chamber 12. Because there is only one cell within the barrel, it is impossible for reflected waves to occur within the barrel. The mini detonation gun is made possible through the use of the aforementioned energy bleed system and the judicious selection of barrel diameters. As is illustrated in FIG. 5 the reflected waves have the greatest destructive impact at point O where they converge on the center of the detonation wave front. Through the use of the energy bleed system the cent of the detonation wave front retains its integrity and is forwarded to the barrel with maximum intensity. In the prior art it was not possible to sustain a single detonation cell within the barrel due to aforementioned destruction of the detonation wave front by the reflected waves both in the combustion chamber and within the barrel itself. The present invention takes advantage of the extremely strong detonation wave and forwards a single detonation cell to the barrel of the detonation gun by employing a barrel with a diameter no smaller than the diameter of a single detonation cell. The detonation cell is intense enough to be sustained within the barrel length and because only a single detonation cell is forwarded to the barrel no reflective waves are created to diminish the detonation cell's intensity as it travels within the barrel. The product is an increase in coating quality, increased coating thickness per shot and increased adhesion strength because the extremely strong detonation is maintained throughout the barrel with a maximum amount of energy transfer to the coating powder and a minimum heating of the substrate because of the small amount of energy exhausted out of the barrel. In addition, the deposition rate is increased through the use of a single detonation cell and associated barrel diameter. As discussed earlier herein the deposition rate is the ratio between the spray rate and the spray spot square. In the Mini detonation gun, the spray spot square is dramatically reduced, from a barrel area of 314 $mm^2$ to 28 $mm^2$ for a given fuel and oxygen mixture, resulting in a proportional increase in deposition rate. This is extremely beneficial in coating small workpieces such as edges of turbine airfoils for jet engines. It is also possible to select more than a single cell for discharging into the barrel. In this embodiment the energy bleed system would be arranged to bleed off that part of the detonation wave front which was not desired. The barrel associated with this embodiment has a diameter equal to the total frontal area of all of the detonation cells selected. Although there are multiple detonation cells within the barrel increasing the chances for their degradation certain applications may benefit from the size of such a configuration.

Figure 6C:
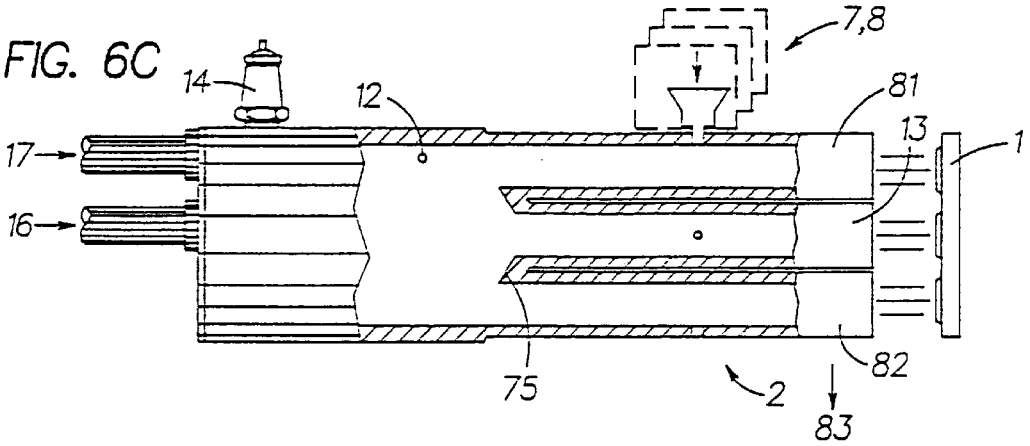
FIG. 6C is a plan view, partially in section, of a multiple barrel detonation gun of the present invention.

An alternative embodiment to the mini detonation gun has multiple single cell barrels and is illustrated in FIG. 6C. The barrels 13, 81, 82, 83 are positioned at the end of the combustion chamber 12 and each are fitted with a powder delivery system 7, 8. In the preferred embodiment each of the barrels is positioned such that reflected energy waves from the converging surface 75 do not destroy the detonation wave front at the centerline of the barrel. An alternative to the preferred embodiment employs the aforementioned energy bleed system. The advantages of the multiple barrel mini detonation gun include the benefit of more of the detonation energy being used in the coating process rather than being absorbed by the energy bleed system, the ability to deposit more coating per shot, and increasing the deposition rate. In addition, layers of different types of coatings are readily achievable by supplying different coating powders to separate powder feeder systems. For instance a first coating is applied by barrels 13 and 81 supplied from powder feeder 7 and then a second different coating is applied by barrels 82 and 83 supplied from powder feeder system 8.

Figure 7A:
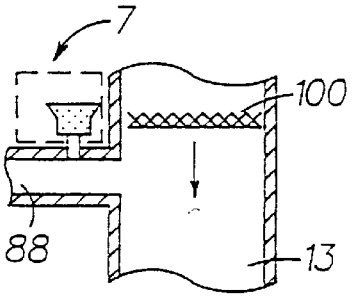
FIG. 7A is a section view of the combustion chamber and barrel in accordance with a preferred embodiment of the present invention illustrating the progression of a detonation wave front within the combustion chamber.
Figure 7B:
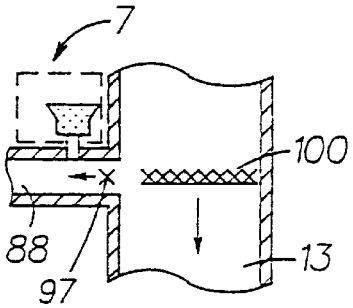
FIG. 7B is a section view of the combustion chamber and barrel in accordance with a preferred embodiment of the present invention illustrating the diffraction of a detonation cell from a detonation wave front within the combustion chamber.
Figure 7C:
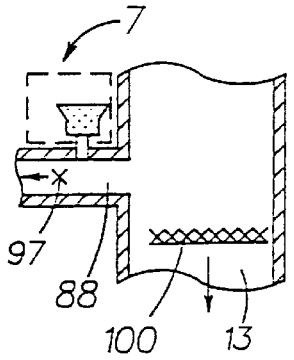
FIG. 7C is a section view of the combustion chamber and barrel in accordance with a preferred embodiment of the present invention illustrating the progression of a diffracted detonation cell within the barrel.

Another alternative embodiment to the mini detonation gun comprises a barrel mounted to the wall of the combustion chamber and takes advantage of the diffraction waves produced by the detonation wave front. As illustrated in FIG. 7A, the detonation wave front 100 progress down the combustion chamber of the detonation gun toward the opened end 13. Mounted in the side of the combustion chamber is a barrel 88 having an inside diameter no smaller than the height of a single detonation cell. As the detonation wave front passes the barrel at least one single detonation cell 97 diffracts off of the detonation wave front and moves into the barrel FIG. 7B. The process is the same as in the previous embodiment in that a powder feeder 7 is installed in the barrel and the detonation cell transports the powder out of the barrel and onto the substrate FIG. 7C. A configuration can also be imagined whereby a single detonation cell barrel could be mounted within the combustion chamber to take advantage of the refracted and reflected waves within the combustion chamber.

Another important aspect of the present invention is the powder feeder system illustrated in FIG. 1. The powder feeder system 7 utilizes pressure from a carrier gas 18 from a constant source (not shown) controlled by a regulating valve 24 to fill a high pressure chamber 38. Exhaust from the high pressure chamber is carried through a branch pipe 40 and controlled by a stop valve 39. The branch pipe exhausts through a nozzle 36 fitted into a hopper 31. Mounted concentrically inside of the nozzle is a supply pipe 35 feeding coating powder 32 from a powder source (not shown). The powder source is sealed from the atmosphere and controlled by the pressure of the carrier gas. The carrier gas transports the powder from the hopper through a removal tube 37 into a barrel 13. The powder feeder system functions in the following manner. The high pressure chamber is filled from the external pressure source to a certain mass of compressed gas, preferably air. At the same time the hopper is being filled with a coating powder at a controlled mass rate from the powder source. The stop valve is opened instaneously to release the entire mass of air from the high volume chamber into the hopper through the nozzle. The effect of the exhausting of the high pressure chamber is to completely fill and evacuate the hopper and removal tube, sending the powder into the barrel. The timing of the stop valve is such that the coating powder is released into the barrel just ahead of the detonation wave as it travels down the barrel. An additional feature of the powder feeder system is that at rapid successive cycling of the stop valve the powder within the hopper forms a fluidized bed, remains in suspension in the air, and is easily transported out into the barrel. The volume of the high pressure chamber is critical in this regard as it must not exceed the combined volumes of the external powder source, the hopper and the removal tube or an excess of air will over pressurize the hopper and preclude the ability to keep the powder in suspension. Just as critical in the operation of the present invention is the relatively short lengths of the branch pipe and the nozzle. The shorter the length of these two components the shorter the lag between a command to open the stop valve from an external controller (not shown) and the discharge of the powder into the barrel. The benefit of this small lag in time is the ability to precisely control the mass of compressed air needed to transport the powder into the barrel. The benefit to detonation gun operation of keeping the powder in suspension is that a relatively small amount of carrier gas is needed to effectively transport the powder into the barrel. The combined effect of these two features is that a relatively small precisely controlled amount of compressed air is released into the barrel which will not substantially reduce the temperature and velocity of the detonation wave. Since the temperature and the velocity of the detonation wave are not substantially distributed more of the kinetic energy from the detonation is transferred to coating powder resulting in better control of coating quality.

Figure 8:
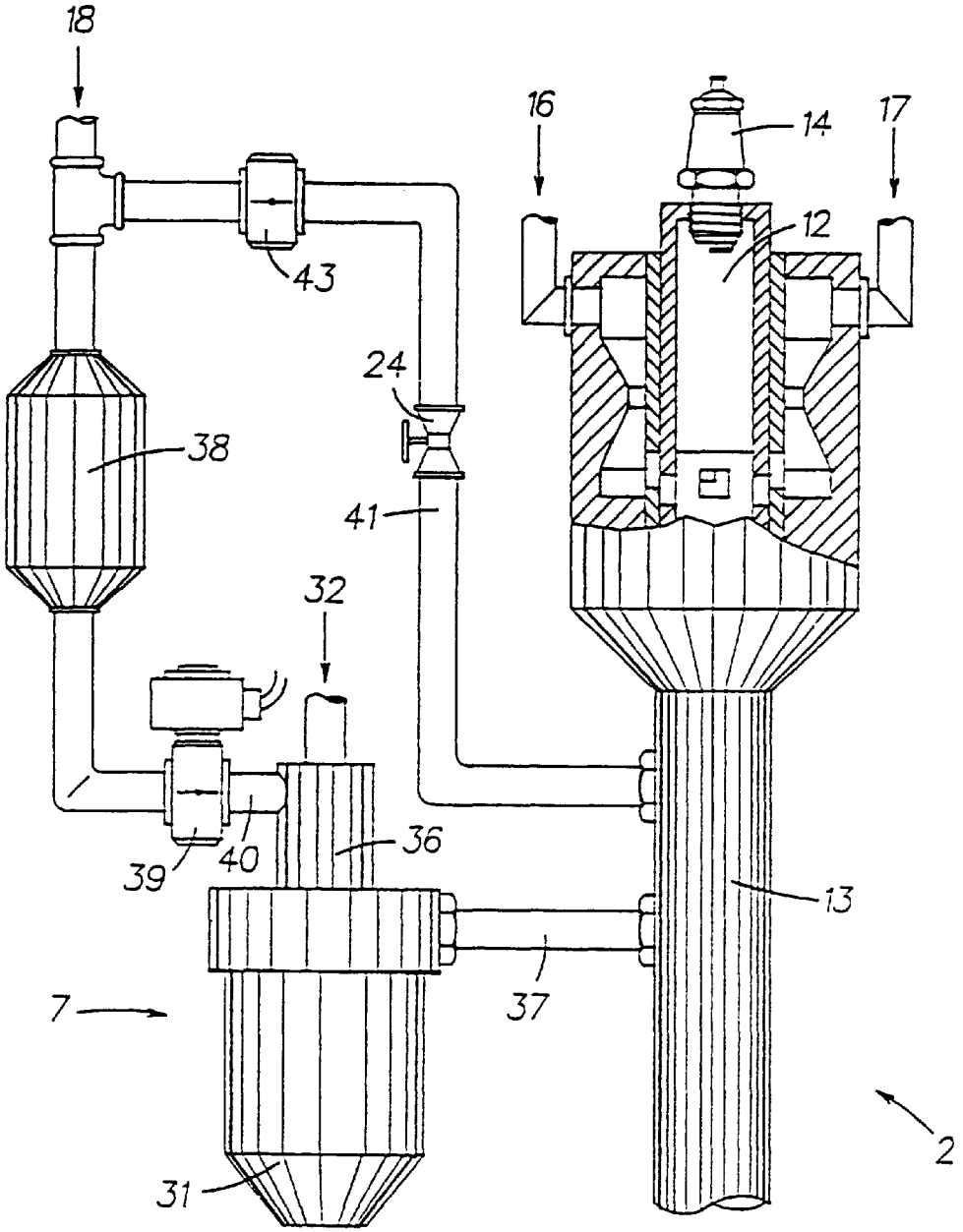
FIG. 8 is a plan view, partially in section illustrating an improved pulsed powder feeder in accordance with one embodiment of the present invention.

In another embodiment of the powder feeder system invention, pressure from the detonation process is utilized to supplement the compressed air source in filling the high pressure chamber as shown in FIG. 8. A transfer pipe 41 is mounted to the barrel 13 of the detonation gun downstream of the point where the detonation process reaches its completion and upstream of the removal tube 37. The transfer pipe is connected to the high pressure chamber via a throttle valve 42 and a one-way valve 43. As the detonation wave front moves down the barrel and encounters the opening of the transfer pipe detonation cells diffract from the detonation wave front and move into the transfer pipe. The amount of pressure transferred from the detonation cell into the powder feeder system is controlled by the throttle valve. Because the compressed air source operates as described above to provide a constant volume of air to the powder feeder system the addition of the one-way valve is necessary to prevent the flow of air into the barrel via the transfer pipe between successive firings of the spark plug. Because the detonation cell moves into the powder feeder system at supersonic speeds it makes it possible to fill the high pressure chamber very rapidly and at virtually the same rate as the firing of the spark plug. As the rate of spark plug firings increases so too does the rate at which the high pressure chamber is filled. This allows the powder feeder system to operate at a very rapid pace thus not limiting the deposition rate of the detonation gun itself.

Figure 9:
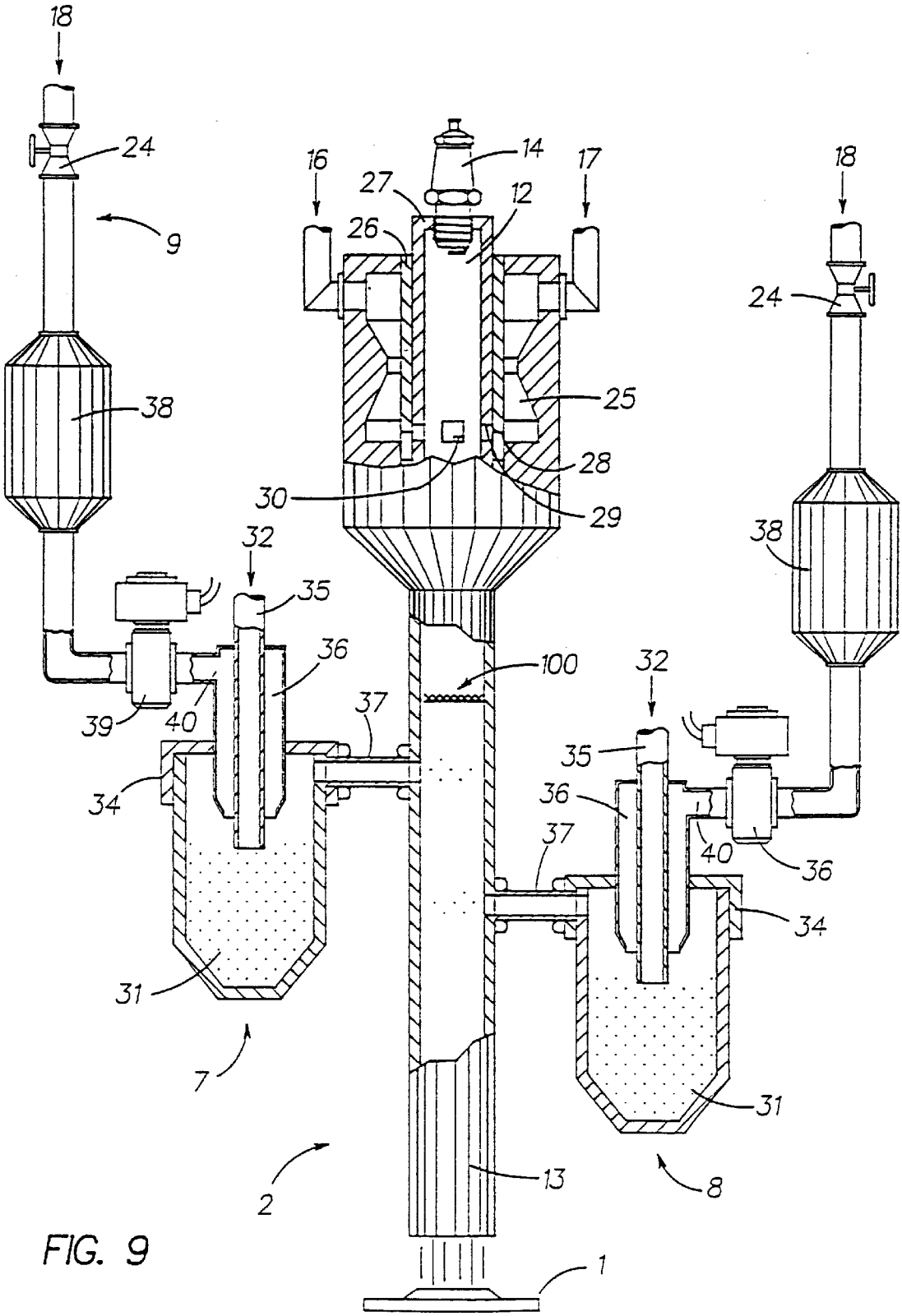
FIG. 9 is a plan view, partially in section a detonation gun and multiple pulsed powder feeders in accordance with one embodiment of the present invention.

Yet another embodiment of the present detonation gun inventions is concerned with the ability to apply multi-layered coatings from a single barrel in a single pass over the substrate. As shown in FIG. 9 the barrel 13 of the detonation gun 2 is fitted with a primary powder feeder system 7 and a secondary powder feeder system 8 downstream of the primary powder feeder system. The two powder feeder systems operate in concert to inject powder ahead of an advancing detonation wave front to form a layered coating on the substrate after each firing of the spark plug 14. An example of the usefulness of the system would be the production of a $Cr_3$—$C_2$—NiCr layered coating in a single pass of the detonation gun over the substrate to produced a hardening coating with good adhesion quality. The $Cr_3C_2$ powder is introduced into the barrel upstream of the NiCr through the powder feeder system 7 and the NiCr powder is introduced through the powder feeder system 8. The NiCr would impact the substrate first and establish a good bond with the substrate and then provide a good bonding layer for the subsequently impacting layer of $Cr_3C_2$. An advantage of the present invention is that multiple layered coatings can be applied in a single pass from a single barrel while eliminating the problems with multiple pass coatings such as preparation, storage, and handling of the substrate between layers. Another advantage of the present invention is that coatings of different densities can be used without the danger of over mixing whereby the denser of the coating powders overtakes the advancement of the less dense coating material as they travel down the barrel. In the embodiment given above the NiCr is more dense than the $Cr_3C_2$. If the NiCr is introduced upstream of, at the same point as or together with the $Cr_3C_2$ then the NiCr would overtake the $Cr_3C_2$ in the barrel, defined herein as overmixing, and the desired coating described above would not be achieved. With the more dense NiCr introduced into the barrel downstream of the $Cr_3C_2$ the powders travel separately within the barrel and produced the desired multi-layered $Cr_3C_2$—NiCr coating on the substrate.

The inventions described herein above contribute individually and in various combinations to enhance the quality and productivity of coating workpieces utilizing a detonation gun process. In the preferred embodiments the velocity of the detonation wave ranges from 1000 m/sec to 3600 m/sec. This represents a 20% increase in maximum velocity over the prior art and translates into better coating quality in terms of density, hardness and resistance to erosion. The deposition rate for the present inventions range from 0.006 $kg/mm^2$-hr to 1.38 $kg/mm^2$-hr representing a an increase in productivity of 68 times that of the prior art.

While we have described particular embodiments of the current invention for purposes of illustration, it is well understood that other embodiments and modifications are possible within the spirit of the invention. Accordingly, the invention is not to be limited except by the scope of the appended claims.

While we have described particular embodiment of the current invention for purposes of illustration, it is well understood that other embodiments and modifications are possible within the spirit of the invention. Accordingly, the invention is not to be limited except by the scope of the appended claims.

What is claimed is:

1. A gas detonation apparatus utilizing energy from a detonation wave front for applying powdered coatings in a downstream direction to a work piece, the gas detonation apparatus having a fuel and oxygen supply, an ignition source, a means for supplying powder, and a barrel, the apparatus further comprising:

a combustion chamber positioned upstream of the barrel and communicating with the ignition source; and in sidewalls of the combustion chamber there is located at least one labyrinth conduct for communicating, through a mixing chamber, directly with the fuel and oxygen supply, the walls of the at least one labyrinth conduct defining a tortuous gas path for the purpose of destroying detonation cells diffracted from the detonation wave front.

2. A gas detonation apparatus as in claim 1 wherein the concentric cylinders (26,27) are circumferentially and axially adjustable.

3. A gas detonation apparatus as in claim 2 wherein the concentric cylinders (26,27) are positioned relative to each other such that the amount of registration between two consecutive apertures is less than the detonation cell height in the axial direction and less than the detonation cell width in the circumferential direction for the purpose of destroying unwanted portions of detonation cells and preventing backfire in the fuel and oxygen supply.

4. A gas detonation apparatus as in claim 3 wherein the plurality of apertures (28,29) are displaced in the sidewalls of adjacent cylinders and the concentric cylinders (26,27) are positioned relative to each other such that the amount of registration between two consecutive apertures is less than the detonation cell height in the axial direction and less than the detonation cell width in the circumferential direction for the purpose of destroying detonation cells diffracted from a detonation wave front and for preventing backfire in the fuel and oxygen supply and such that the misregistration of at least a pair of apertures defines a completely closed off gas path for the purpose of limiting the flow of fuel and oxygen into the combustion chamber.

5. A gas detonation apparatus as in claim 1, wherein the mixing chamber is an annular chamber (25) located between the fuel and oxygen supply (16,17) and the combustion chamber (12) the annular mixing chamber (25) further comprising in serial arrangement:

a first section communicating with the fuel and oxygen supply;

a second section communicating with the first section and radially converging in the downstream direction;

a third section communicating with the second section and radially diverging in downstream direction; and a fourth section communicating with the third section and the combustion chamber (12) and allowing sufficient combustion backflow to enter the third section of the mixing chamber from the combustion chamber to instantaneously interrupt the fuel supply from the second section, thereby preventing backfiring.

6. A gas detonation apparatus as in claim 1 wherein the walls of the at least one labyrinth comprise a plurality of flat surfaces positioned perpendicular to the gas path for the purpose of destroying, by collision against the flat surfaces, detonation cells diffracted from the detonation wave front and so for preventing backfire in the fuel and oxygen supply.

7. A gas detonation apparatus utilizing energy from a detonation wave front for applying powdered coatings in a downstream direction to a work piece, the gas detonation apparatus having a fuel and oxygen supply, an ignition source, a means for delivering powder, and a barrel, the apparatus further comprising:

a combustion-chamber positioned between the ignition source and the barrel, and supplied, through a mixing chamber, directly with a combustible mixture of fuel and oxygen provided by the fuel and oxygen supply;

the combustion chamber comprised of at least two concentric cylinders in concentric contact with one another; and the cylinders having a plurality of apertures in selective registry with one another and located in sidewalls of the combustion chambers for providing communication between the combustion chamber and the fuel and oxygen supply.

8. A method for preventing backfire in a gas detonation apparatus utilizing energy from a detonation wave front, the detonation wave-front having detonation cells for applying powdered coatings in a downstream direction to a work piece, the gas detonation apparatus having a fuel and oxygen supply, an ignition source, a combustion chamber, a labyrinth conduct having walls which define a tortuous path within the walls of the combustion chamber and communicating directly, through a mixing chamber, with the fuel and oxygen supply, a means for delivering powder, and a barrel, the method comprising:

producing a detonation wave front within the combustion chamber;

permitting a portion of the detonation wave front to enter the tortuous path; and colliding the portion of the detonation wave front with the walls of the tortuous path and thereby destroying the detonation cells and preventing backfire into the fuel and oxygen supply.

* * * * *